US006273629B1

(12) United States Patent
Jordan

(10) Patent No.: US 6,273,629 B1
(45) Date of Patent: Aug. 14, 2001

(54) TOOTHPASTE DISPENSING TOOTHBRUSH

(76) Inventor: Kenya Scott Jordan, 1006 Bordentown Ave., Parlin, NJ (US) 08859

( * ) Notice: Subject to any disclaimer, the term of this patent is extended or adjusted under 35 U.S.C. 154(b) by 0 days.

(21) Appl. No.: 09/557,205

(22) Filed: Apr. 21, 2000

(51) Int. Cl.[7] ..... A46B 11/04; A47L 13/22

(52) U.S. Cl. ..... 401/286; 401/158; 401/281; 401/282

(58) Field of Search ..... 401/143, 145, 401/156, 158, 162, 161, 84, 271, 278–282, 286, 288; 132/308, 310, 311; 222/98–101, 387, 388

(56) References Cited

U.S. PATENT DOCUMENTS

| | | | | |
|---|---|---|---|---|
| D. 393,748 | | 4/1998 | Peltier | D4/108 |
| 1,465,840 | * | 8/1923 | Celano | 401/155 |
| 4,622,984 | | 11/1986 | Gaebel | 132/84 |
| 4,826,341 | * | 5/1989 | Kwak | 401/155 |
| 5,382,106 | * | 1/1995 | Voigt | 401/155 |
| 5,636,933 | | 6/1997 | Vizsolyi | 401/269 |
| 5,827,001 | * | 10/1998 | Taghavi-Khanghah | 401/145 |
| 5,913,632 | * | 6/1999 | Persad | 401/175 |

* cited by examiner

*Primary Examiner*—Gregory L. Huson
*Assistant Examiner*—Tuan Nguyen
(74) *Attorney, Agent, or Firm*—Goldstein Law Offices P.

(57) ABSTRACT

A toothpaste dispensing toothbrush including a toothbrush portion comprised of a cylindrical body. The cylindrical body has an upper end, an open lower end, and a hollow interior. The upper end has an elongated stem extending upwardly therefrom. The elongated stem has a plurality of bristles extending laterally therefrom. The elongated stem has an opening therein corresponding to the bristles. A toothpaste tube is provided that stores a quantity of toothpaste therein. The toothpaste tube is received within the hollow interior of the cylindrical body of the toothbrush portion. The toothpaste tube is comprised of a circular base having an elongated tube extending upwardly therefrom. The elongated tube has an outwardly turned open upper end. The circular tube is positioned within the open lower end of the cylindrical body with the elongated tube extending through the hollow interior of the cylindrical body into the elongated stem with the outwardly turned open upper end directed into the opening in the elongated stem. A dispensing mechanism is provided that is adapted for forcing toothpaste outwardly of the outwardly turned open upper end of the elongated tube of the toothpaste tube through the opening of the elongated stem and onto the bristles.

4 Claims, 1 Drawing Sheet

TOOTHPASTE DISPENSING TOOTHBRUSH

BACKGROUND OF THE INVENTION

The present invention relates to a toothpaste dispensing toothbrush and more particularly pertains to allowing toothpaste to be stored in and dispensed directly on the toothbrush for immediate use.

The use of combination toothbrush devices is known in the prior art. More specifically, combination toothbrush devices heretofore devised and utilized for the purpose of combining toothbrushes with other dental hygiene related devices are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,622,984 to Gaebel discloses a toothbrush and toothpaste dispenser comprised of a hand manipulated rotating shaft with a transparent indicator window and is capable of dispensing paste through the bristles. U.S. Pat. No. 5,636,933 to Vizolyi discloses a combination travel toothbrush and toothpaste dispenser. U.S. Pat. No. Des. 393,748 to Peltier discloses an ornamental design for a toothpaste dispensing brush.

While these devices fulfill their respective, particular objective and requirements, the aforementioned patents do not describe a toothpaste dispensing toothbrush for allowing toothpaste to be stored in and dispensed directly on the toothbrush for immediate use.

In this respect, the toothpaste dispensing toothbrush according to the present invention substantially departs from the conventional concepts and designs of the prior art, and in doing so provides an apparatus primarily developed for the purpose of allowing toothpaste to be stored in and dispensed directly on the toothbrush for immediate use.

Therefore, it can be appreciated that there exists a continuing need for a new and improved toothpaste dispensing toothbrush which can be used for allowing toothpaste to be stored in and dispensed directly on the toothbrush for immediate use. In this regard, the present invention substantially fulfills this need.

SUMMARY OF THE INVENTION

In the view of the foregoing disadvantages inherent in the known types of combination toothbrush devices now present in the prior art, the present invention provides an improved toothpaste dispensing toothbrush. As such, the general purpose of the present invention, which will be described subsequently in greater detail, is to provide a new and improved toothpaste dispensing toothbrush which has all the advantages of the prior art and none of the disadvantages.

To attain this, the present invention essentially comprises a toothbrush portion comprised of a cylindrical body. The cylindrical body has an upper end, an open lower end, and a hollow interior. The upper end has an elongated stem extending upwardly therefrom. The elongated stem has a plurality of bristles extending laterally therefrom. The plurality of bristles include outer sections of long bristles and a central section of short bristles. The elongated stem has an opening therein corresponding to the central section of short bristles. The cylindrical body and the elongated stem are transparent. A toothpaste tube is provided that stores a quantity of toothpaste therein. The toothpaste tube is received within the hollow interior of the cylindrical body of the toothbrush portion. The toothpaste tube is comprised of a circular base having an elongated tube extending upwardly therefrom. The elongated tube has an outwardly turned open upper end. The circular tube is positioned within the open lower end of the cylindrical body with the elongated tube extending through the hollow interior of the cylindrical body into the elongated stem with the outwardly turned open upper end directed into the opening in the elongated stem. A dispensing mechanism is provided that is adapted for forcing toothpaste outwardly of the outwardly turned open upper end of the elongated tube of the toothpaste tube through the opening of the elongated stem and onto the central section of short bristles.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved toothpaste dispensing toothbrush which has all the advantages of the prior art combination toothbrush devices and none of the disadvantages.

It is another object of the present invention to provide a new and improved toothpaste dispensing toothbrush which may be easily and efficiently manufactured and marketed.

It is a further object of the present invention to provide a new and improved toothpaste dispensing toothbrush which is of durable and reliable construction.

An even further object of the present invention is to provide a new and improved toothpaste dispensing toothbrush which is susceptible of a low cost of manufacture with regard to both materials and labor, and which accordingly is then susceptible of low prices of sale to the consuming public, thereby making such a toothpaste dispensing toothbrush economically available to the buying public.

Even still another object of the present invention is to provide a new and improved toothpaste dispensing toothbrush for allowing toothpaste to be stored in and dispensed directly on the toothbrush for immediate use.

Lastly, it is an object of the present invention to provide a new and improved toothpaste dispensing toothbrush including a toothbrush portion comprised of a cylindrical body. The cylindrical body has an upper end, an open lower end, and a hollow interior. The upper end has an elongated stem extending upwardly therefrom. The elongated stem has a plurality of bristles extending laterally therefrom. The elongated stem has an opening therein corresponding to the bristles. A toothpaste tube is provided that stores a quantity of toothpaste therein. The toothpaste tube is received within the hollow interior of the cylindrical body of the toothbrush portion. The toothpaste tube is comprised of a circular base having an elongated tube extending upwardly therefrom. The elongated tube has an outwardly turned open upper end. The circular tube is positioned within the open lower end of the cylindrical body with the elongated tube extending through the hollow interior of the cylindrical body into the elongated stem with the outwardly turned open upper end directed into the opening in the elongated stem. A dispensing mechanism is provided that is adapted for forcing toothpaste outwardly of the outwardly turned open upper end of the elongated tube of the toothpaste tube through the opening of the elongated stem and onto the bristles.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 2:
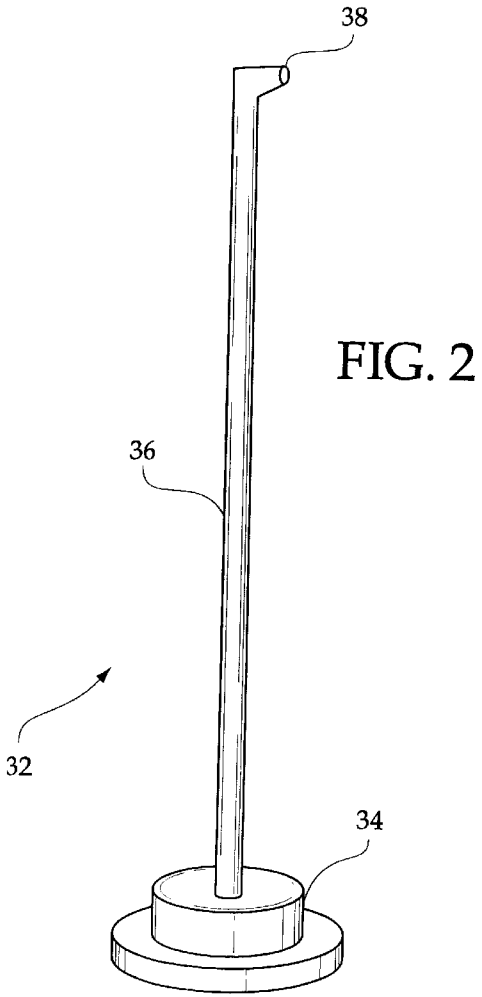
FIG. 2 is a side view of the toothpaste tube of the present invention.
Figure 1:
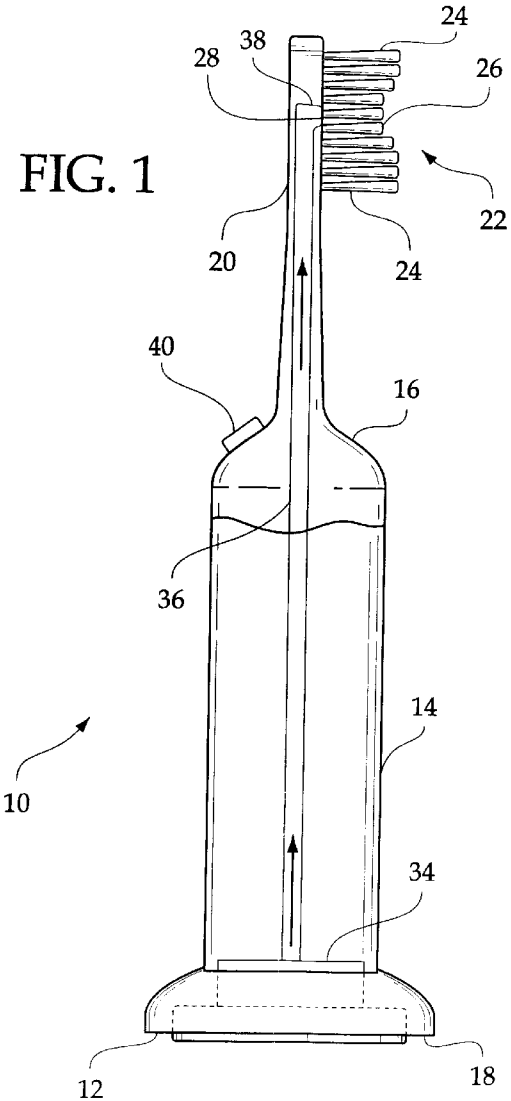
FIG. 1 is a side view of the preferred embodiment of the toothpaste dispensing toothbrush constructed in accordance with the principles of the present invention.

With reference now to the drawings, and in particular, to FIGS. 1 and 2 thereof, the preferred embodiment of the new and improved toothpaste dispensing toothbrush embodying the principles and concepts of the present invention and generally designated by the reference number 10 will be described.

Specifically, it will be noted in the various Figures that the device relates to a toothpaste dispensing toothbrush for allowing toothpaste to be stored in and dispensed directly on the toothbrush for immediate use. In its broadest context, the device consists of a toothbrush portion, a toothpaste tube, and a dispensing mechanism. Such components are individually configured and correlated with respect to each other so as to attain the desired objective.

The toothbrush portion 12 is comprised of a cylindrical body 14. The cylindrical body 14 has an upper end 16, an open lower end 18, and a hollow interior. The open lower end, as illustrated in FIG. 1, is enlarged to provide stability for standing the device 10 upright. The upper end 16 has an elongated stem 20 extending upwardly therefrom. The elongated stem 20 has a plurality of bristles 22 extending laterally therefrom. The plurality of bristles 22 include outer sections of long bristles 24 and a central section of short bristles 26. The elongated stem 20 has an opening 28 therein corresponding to the central section of short bristles 26. The cylindrical body 14 and the elongated stem 20 are transparent. Note FIG. 1.

The toothpaste tube 32 stores a quantity of toothpaste therein. The toothpaste tube 32 is received within the hollow interior of the cylindrical body 14 of the toothbrush portion 12. The toothpaste tube 32 is comprised of a circular base 34 having an elongated tube 36 extending upwardly therefrom. The elongated tube 36 has an outwardly turned open upper end 38. The circular tube 36 is positioned within the open lower end 18 of the cylindrical body 14 with the elongated tube 36 extending through the hollow interior of the cylindrical body 14 into the elongated stem 20 with the outwardly turned open upper end 38 directed into the opening 28 in the elongated stem 20.

The dispensing mechanism is provided that is adapted for forcing toothpaste outwardly of the outwardly turned open upper end 38 of the elongated tube 36 of the toothpaste tube 32 through the opening 28 of the elongated stem 20 and onto the central section of short bristles 26. In the preferred embodiment, the dispensing mechanism is comprised of a trigger button 40, that when pressed, will force the toothpaste out through the outwardly turned open upper end 38. Alternately, the circular base 34 can be rotatable whereby the rotation will effectively dispense the toothpaste out through the outwardly turned open upper end 38.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toothpaste dispensing toothbrush for allowing toothpaste to be stored in and dispensed directly on the toothbrush for immediate use comprising, in combination:

a toothbrush portion comprised of a cylindrical body, the cylindrical body having an upper end, an open lower end, and a hollow interior, the upper end having an elongated stem extending upwardly therefrom, the elongated stem having a plurality of bristles extending laterally therefrom, the plurality of bristles including outer sections of long bristles and a central section of short bristles, the elongated stem having an opening therein corresponding to the central section of short bristles, the cylindrical body and the elongated stem being transparent;

a toothpaste tube storing a quantity of toothpaste therein, the toothpaste tube being removably received within the hollow interior of the cylindrical body of the toothbrush portion, the toothpaste tube being comprised of a circular base having an elongated tube extending upwardly therefrom, the elongated tube having an outwardly turned open upper end, the circular base being positioned within the open lower end of the cylindrical body with the elongated tube extending through the hollow interior of the cylindrical body into the elongated stem with the outwardly turned open upper end directed into the opening in the elongated stem;

a dispensing mechanism adapted for forcing toothpaste outwardly of the outwardly turned open upper end of the elongated tube of the toothpaste tube through the opening of the elongated stem and onto the central section of short bristles.

2. A toothpaste dispensing toothbrush for allowing toothpaste to be stored in and dispensed directly on the toothbrush for immediate use comprising, in combination:

a toothbrush portion comprised of a cylindrical body, the cylindrical body having an upper end, an open lower end, and a hollow interior, the upper end having an elongated stem extending upwardly therefrom, the elongated stem having a plurality of bristles extending laterally therefrom, the elongated stem having an opening therein corresponding to the bristles;

a toothpaste tube storing a quantity of toothpaste therein, the toothpaste tube being removably received within the hollow interior of the cylindrical body of the toothbrush portion, the toothpaste tube being comprised of a circular base having an elongated tube extending upwardly therefrom, the elongated tube having an outwardly turned open upper end, the circular base being positioned within the open lower end of the cylindrical body with the elongated tube extending through the hollow interior of the cylindrical body into the elongated stem with the outwardly turned open upper end directed into the opening in the elongated stem;

a dispensing mechanism adapted for forcing toothpaste outwardly of the outwardly turned open upper end of the elongated tube of the toothpaste tube through the opening of the elongated stem and onto the bristles.

3. The toothpaste dispensing toothbrush as set forth in claim 2 wherein the plurality of bristles include outer sections of long bristles and a central section of short bristles.

4. The toothpaste dispensing toothbrush as set forth in claim 2 wherein the cylindrical body and the elongated stem are transparent.

* * * * *